US007892398B2

(12) United States Patent
Johansson-Vestin et al.

(10) Patent No.: US 7,892,398 B2
(45) Date of Patent: Feb. 22, 2011

(54) SIZING OF PAPER

(75) Inventors: Hans Johansson-Vestin, Kungälv (SE); Jonas Liesén, Jörlanda (SE); Marie Turunen, Spekeröd (SE); Jan Emanuelsson, Stenungsund (SE)

(73) Assignee: Akzo Nobel N.V., Arnhem (NL)

( * ) Notice: Subject to any disclaimer, the term of this patent is extended or adjusted under 35 U.S.C. 154(b) by 951 days.

(21) Appl. No.: 11/638,108

(22) Filed: Dec. 13, 2006

(65) Prior Publication Data

US 2007/0137523 A1 Jun. 21, 2007

Related U.S. Application Data

(60) Provisional application No. 60/752,656, filed on Dec. 21, 2005.

(51) Int. Cl.

| | |
|---|---|
| ***D21H 21/16*** | (2006.01) |
| ***D21H 17/03*** | (2006.01) |
| ***D21H 17/21*** | (2006.01) |
| ***D21H 17/68*** | (2006.01) |

(52) U.S. Cl. ..... 162/158; 162/175; 162/181.6; 106/164.3; 106/214.1; 106/214.2; 106/287.2; 106/287.23; 106/287.25

(58) Field of Classification Search ..... 106/287.2, 106/214.1, 214.2, 164.3, 287.23, 287.25; 162/158, 175, 181.6
See application file for complete search history.

(56) References Cited

U.S. PATENT DOCUMENTS

| | | | | |
|---|---|---|---|---|
| 3,102,064 | A * | 8/1963 | Mazzarella et al. | 162/158 |
| 3,821,069 | A | 6/1974 | Wurzburg | 162/158 |
| 3,968,005 | A | 7/1976 | Wurzburg | 162/158 |
| 4,040,900 | A | 8/1977 | Mazzarella et al. | 162/158 |
| RE29,960 | E | 4/1979 | Mazzarella et al. | 162/158 |
| 4,522,686 | A | 6/1985 | Dumas | 162/158 |
| 5,643,864 | A * | 7/1997 | Li et al. | 510/499 |
| 5,759,249 | A * | 6/1998 | Wasser | 106/209.1 |
| 5,969,011 | A | 10/1999 | Frölich et al. | 524/35 |
| 5,972,100 | A | 10/1999 | Dumas | 106/501.1 |
| 6,183,550 | B1 * | 2/2001 | Conner et al. | 106/209.1 |
| 6,306,255 | B1 | 10/2001 | Frölich et al. | 162/158 |
| 2003/0127205 | A1 | 7/2003 | Odberg et al. | 162/135 |

FOREIGN PATENT DOCUMENTS

| | | | |
|---|---|---|---|
| EP | 0141641 | * | 5/1985 |
| EP | 0235893 | * | 9/1987 |
| WO | WO 96/17127 | | 6/1996 |
| WO | WO 97/31152 | | 8/1997 |
| WO | WO 98/33979 | | 8/1998 |
| WO | WO 00/15906 | | 3/2000 |
| WO | WO 03/074787 | | 9/2003 |

* cited by examiner

*Primary Examiner*—David M Brunsman
(74) *Attorney, Agent, or Firm*—Robert C. Morriss

(57) ABSTRACT

The invention relates to an aqueous dispersion of cellulose-reactive sizing agent containing an acid anhydride, an anionic polyelectrolyte and a nitrogen-containing organic compound which is an amine or quaternary ammonium thereof having a molecular weight less than 180 and/or having one or more hydroxyl groups. The invention further relates to a process for the production of paper which comprises adding the aqueous dispersion of cellulose-reactive sizing agent to an aqueous cellulosic suspension.

12 Claims, No Drawings

SIZING OF PAPER

FIELD OF THE INVENTION

The present invention relates to sizing of paper and more specifically to aqueous dispersions of cellulose-reactive sizing agent and their preparation and use.

BACKGROUND OF THE INVENTION

Cellulose-reactive sizing agents such as those based on alkenyl succinic anhydride (ASA) are widely used in papermaking at neutral or slightly alkaline stock pH's in order to give paper and paper board some degree of resistance to wetting and penetration by aqueous liquids. Paper sizes based on cellulose-reactive sizing agents are generally provided in the form of dispersions containing an aqueous phase and finely divided particles or droplets of the sizing agent dispersed therein. The dispersions are usually prepared with the aid of a dispersant system consisting of an anionic compound, e.g. sodium lignosulfonate, in combination with a high molecular weight amphoteric or cationic polymer, e.g. cationic starch, polyamine, polyamideamine or a vinyl addition polymer.

WO 96/17127 discloses aqueous dispersions which comprise a cellulose-reactive sizing agent and colloidal anionic aluminium-modified silica particles.

WO 97/31152 discloses aqueous dispersions which comprise a reactive size and an anionic microparticulate material. The dispersions may also contain not more than 2% (by weight based on the weight of the reactive size) of surfactant. The surfactant can be non-ionic or anionic.

WO 98/33979 A1 discloses an aqueous dispersion of cellulose-reactive sizing agent and a dispersant system comprising a cationic organic compound and an anionic stabilizer.

Despite the fact that considerable improvements have been achieved in the preparation, properties and performance of aqueous dispersions of alkenyl succinic anhydride, there are still some technical problems associated with the use of such dispersions. Usually, dispersions of alkenyl succinic anhydride exhibit poor stability, which evidently leads to difficulties in handling the dispersions, for example on storage and in use. One further drawback is that the aqueous dispersions cannot be stored for longer periods of time, because alkenyl succinic anhydride hydrolyses easily and thereby becomes ineffective as a sizing agent. Therefore, the alkenyl succinic anhydride is usually delivered to paper mills as a liquid, which is then dispersed prior to its use as a sizing agent and the dispersion obtained is usually used within 2 hours to avoid the problems of insufficient stability and loss of sizing efficiency. The equipment used to prepare the dispersions provides high shear forces to be able to set surfaces free and produce dispersions having adequate particle size. Such equipment is often both complicated and expensive, and due to the high shear forces usually requires a considerable amount of energy.

It is an object of this invention to provide an aqueous dispersion of cellulose-reactive sizing agent which can be easily prepared using low shear forces and low energy consumption. It is a further object of this invention to provide an aqueous dispersion of cellulose-reactive sizing agent showing improved stability and sizing efficiency. Further objects will appear hereinafter.

SUMMARY OF THE INVENTION

The invention relates to an aqueous dispersion of cellulose-reactive sizing agent containing an acid anhydride, an anionic polyelectrolyte and a nitrogen-containing organic compound which is an amine or quaternary ammonium thereof having a molecular weight less than 180 and/or having one or more hydroxyl groups.

The invention further relates to a method for the preparation of an aqueous dispersion of cellulose-reactive sizing agent which comprises dispersing an acid anhydride in an aqueous phase in the presence of an anionic polyelectrolyte and a nitrogen-containing organic compound which is an amine or quaternary ammonium thereof having a molecular weight less than 180 and/or having one or more hydroxyl groups.

The invention also relates to the use of the aqueous dispersion of cellulose-reactive sizing agent as a stock sizing agent or surface sizing agent in the production of paper. The invention further relates to a process for the production of paper which comprises adding the aqueous dispersion of cellulose-reactive sizing agent to an aqueous cellulosic suspension and dewatering the obtained suspension on a wire as well as a process for the production of paper which comprises applying the aqueous dispersion of cellulose-reactive sizing agent to a cellulosic web.

DETAILED DESCRIPTION OF THE INVENTION

In accordance with the present invention it has been found that improved sizing of paper can be achieved by using the present aqueous dispersion of cellulose-reactive sizing agent. It has also been found that the present dispersions show better stability over conventional dispersions. Furthermore, it has been found that lower shear forces can be used to prepare the present aqueous dispersions compared to when preparing conventional aqueous dispersions of cellulose-reactive sizing agent. Hereby the present invention makes it possible to use simple and energy and investment saving equipment creating low shear forces, such as for example static mixers. The present invention thus offers substantial economical and technical benefits.

The cellulose-reactive sizing agent according to the invention can be selected from any acid anhydride-based sizing agent known in the art. Suitably, the sizing agent is a hydrophobic acid anhydride. Suitable hydrophobic acid anhydrides can be characterized by the general formula (I) below, wherein $R^1$ and $R^2$ are independently selected from saturated or unsaturated hydrocarbon groups which suitably contain from 8 to 30 carbon atoms, or $R^1$ and $R^2$ together with the —C—O—C— moiety can form a 5 to 6 membered ring, optionally being further substituted with hydrocarbon groups containing up to 30 carbon atoms.

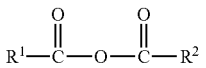

(I)

Examples of suitable acid anhydrides include alkyl and alkenyl succinic anhydrides, e.g. iso-octadecenyl succinic anhydride, iso-octadecyl succinic anhydride, n-hexadecenyl succinic anhydride, dodecenyl succinic anhydride, decenyl succinic anhydride, octenyl succinic anhydride, tri-isobutenyl succinic anhydride, 1-octyl-2-decenyl-succinic anhydride and 1-hexyl-2-octenyl-succinic anhydride. Examples of suitable acid anhydrides further include the compounds disclosed in U.S. Pat. Nos. 3,102,064; 3,821,069; 3,968,005; 4,040,900; 4,522,686; and Re. 29,960, which are hereby incorporated herein by reference.

The cellulose-reactive sizing agent according to the invention may contain one or more acid anhydrides, e.g. one or more alkyl and/or alkenyl succinic anhydrides. Usually, the acid anhydride of this invention is liquid at room temperature.

The dispersion according to the invention contains a dispersant, or dispersant system, comprising an anionic polyelectrolyte and a nitrogen-containing organic compound. When used in combination, these compounds are effective as a dispersant for the acid anhydride sizing agent although the anionic polyelectrolyte and nitrogen-containing organic compound may not be effective as a dispersant when used singly. Preferably, the dispersion is anionic, i.e. the dispersant, or dispersant system, has an overall anionic charge.

The anionic polyelectrolyte according to the invention can be selected from organic and inorganic compounds and it can be derived from natural or synthetic sources. The anionic polyelectrolyte has two or more anionic groups which can be of the same or different types. Examples of suitable anionic groups, i.e. groups that are anionic or rendered anionic in an aqueous phase, include silanol, aluminosilicate, phosphate, phosphonate, sulphate, sulphonate, sulphonic and carboxylic acid groups as well as salts thereof, usually ammonium or alkali metal (generally sodium) salts. The anionic polyelectrolytes may be water-soluble, e.g. linear and branched anionic polyelectrolytes, or water-dispersable, e.g. crosslinked and/or particulate anionic polyelectrolytes. Preferably, the water-dispersable and particulate anionic polyelectrolytes are colloidal, i.e. in the colloidal range of particle size. The colloidal particles suitably have a particle size from 1 nm to 100 nm, preferably from 2 to 70 nm and most preferably from 2 to 40 nm. The water-dispersable and particulate anionic polyelectrolytes may contain aggregated and/or non-aggregated particles.

Examples of suitable organic anionic polyelectrolytes include anionic polysaccharides like starches, guar gums, celluloses, chitins, chitosans, glycans, galactans, glucans, xanthan gums, mannans, and dextrins. Further examples of suitable organic anionic polyelectrolytes include synthetic anionic polymers such as condensation polymers, e.g. polyurethanes and naphthalene-based and melamine-based polymers, e.g. condensated formaldehyde naphthalene sulfonates and polymers based on melamine-sulfonic acid, and vinyl addition polymers prepared from ethylenically unsaturated monomers including anionic or potentially anionic monomers, e.g. acrylic acid, methacylic acid, maleic acid, itaconic acid, crotonic acid, vinylsulfonic acid, sulfonated styrene and phosphates of hydroxyalkyl acrylates and methacrylates, optionally copolymerized with non-ionic ethylenically unsaturated monomers, e.g. acrylamide, alkyl acrylates, styrene and acrylonitrile as well as derivatives of such monomers, vinyl esters, and the like.

Examples of further suitable organic anionic polyelectrolytes include water-soluble branched polymers and water-dispersible crosslinked polymers obtained by polymerization of a monomer mixture comprising one or more ethylenically unsaturated anionic or potentially anionic monomers and, optionally, one or more other ethylenically unsaturated monomers, in the presence of one or more polyfunctional crosslinking agents. The presence of a polyfunctional crosslinking agent in the monomer mixture renders possible preparation of branched polymers, slightly crosslinked polymers and highly crosslinked polymers that are water-dispersible. Examples of suitable polyfunctional crosslinking agents include compounds having at least two ethylenically unsaturated bonds, e.g. N,N-methylene-bis(meth)acrylamide, polyethyleneglycol di(meth)acrylate, N-vinyl (meth)acrylamide, divinylbenzene, triallylammonium salts and N-methylallyl(meth)acrylamide; compounds having an ethylenically unsaturated bond and a reactive group, e.g. glycidyl (meth) acrylate, acrolein and methylol(meth)acrylamide; and compounds having at least two reactive groups, e.g. dialdehydes like glyoxal, diepoxy compounds and epichlorohydrin.

The organic anionic polyelectrolyte usually has a degree of anionic substitution ($DS_A$) from 0.01 to 1.4, suitably from 0.1 to 1.2 and preferably from 0.2 to 1.0. The anionic polyelectrolyte may contain one or more cationic groups as long as it has an overall anionic charge. The molecular weight of the anionic polyelectrolyte can vary within wide ranges; usually the molecular weight is above 200 and suitably above 500, whereas the upper limit is usually 10 million and preferably 2 million.

Examples of suitable inorganic anionic polyelectrolytes include anionic siliceous materials, e.g. anionic silica-based materials prepared from silicic acid and clays of the smectite type. Usually, these anionic polyelectrolytes have negative silanol, aluminosilicate or hydroxyl groups. Examples of suitable inorganic anionic polyelectrolytes include polysilicic acid, polysilicates, polyaluminiumsilicates, colloidal silica-based particles, e.g. particles of silica, aluminated (aluminium-modified) silica and aluminiumsilicate, polysilicate microgels, polyaluminiumsilicate microgels, silica gels and precipitated silica, smectite clays, e.g. montmorillonite, bentonite, hectorite, beidelite, nontronite and saponite. Preferred anionic polyelectrolytes include silica-based materials, e.g. colloidal silica-based particles.

The nitrogen-containing organic compound according to the invention is an amine or quaternary ammonium thereof. Suitable nitrogen-containing organic compounds include primary, secondary and tertiary amines and quaternary ammoniums thereof. Suitable nitrogen-containing organic compounds further include monoamines, diamines and polyamines and quaternary ammoniums thereof. Suitable quaternary ammoniums include protonated, alkylated, arylated and alkarylated amines of the above-mentioned types, which can be formed by reaction of the amines with, for example, acids, e.g. hydrochloric acid, and methyl chloride, dimethyl sulphate and benzyl chloride. In a preferred embodiment of the invention, the nitrogen-containing organic compound is an amine or quaternary ammonium thereof having one or more hydroxyl groups. Preferably, one or more hydroxyl groups are present in a terminal position of one or more substituents of the nitrogen-containing compound, i.e. a hydroxyl group terminated amine or quaternary ammonium thereof.

Examples of suitable nitrogen-containing organic compounds include the following amines and their quaternary ammoniums: diethylene triamine, triethylene tetramine, hexamethylene diamine, diethyl amine, dipropyl amine, di-isopropyl amine, cyclohexylamine, pyrrolidine, guanidine, triethanol amine, monoethanol amine, diethanol amine, 2-methoxyethyl amine, aminoethylethanol amine, alanine and lysine. Further examples of suitable nitrogen-containing organic compounds include choline hydroxide, tetramethyl ammoniumhydroxide, tetraethyl ammoniumhydroxide. Preferred nitrogen-containing organic compounds include triethanol amine and quaternary ammoniums thereof.

The molecular weight of the nitrogen containing organic compound can vary within wide limits. In a preferred embodiment of the invention, the molecular weight of the amine or quaternary ammonium thereof is less than 180, suitably up to 170 and preferably up to 160. The molecular weight is usually at least 30. As stated herein, the molecular weight of a quaternary ammonium of an amine means the molecular weight of the cationic part of the quaternary ammonium compound, meaning that the anionic part of the quaternary ammonium compound is not included in the molecular weights given above. For nitrogen-containing organic compounds which are selected from amines and quaternary ammoniums thereof having one or more hydroxyl groups, the molecular weights may be higher, e.g. less than 500 and usually less than 300, although the above-mentioned molecular weights are also suitable for such compounds.

In the present aqueous dispersion, or emulsion, the acid anhydride may be present in an amount of from about 0.1 to about 50% by weight, suitably from 0.1 to about 30% by weight and preferably from about 1 to about 20% by weight, based on the weight of the aqueous dispersion. The anionic polyelectrolyte is usually present in an amount of up to about 100% by weight, usually from 0.1 to 15% by weight, suitably from 0.5 to 10% by weight and preferably from 1 to 7% by weight, based on the weight of the acid anhydride. The nitrogen containing organic compound can be present in an amount of up to 20% by weight, usually from 0.1 to 15% by weight, suitably from 0.5 to 10% by weight and preferably from 1 to 7% by weight, based on the weight of the acid anhydride. In addition to the acid anhydride, anionic polyelectrolyte and nitrogen containing organic compound, optional additional compounds may be present in the dispersion. Examples of such compounds include mono-, di- and poly-anionic and non-ionic surfactants and dispersing agents, stabilizers, extenders and preservative agents such as, for example, hydrolyzed acid anhydrides, e.g. hydrolyzed alkyl and alkenyl acid anhydrides as mentioned above, preferably hydrolyzed alkenyl succinic anhydrides, e.g. hydrolyzed acid anhydrides in the form of carboxylic acid and/or carboxylic acid ester derivatives, anionic surfactants like phosphate esters, such as ethoxylated phosphate esters, alkyl sulphates, sulphonates and phosphates, alkylaryl sulphates, sulphonates and phosphates, e.g. sodium lauryl sulphonate and ethoxylated, phosphated isotridecylalcohol. If present, the content of such additional compounds in the dispersion can be from 0.1 to 15% by weight, suitably from 1 to 10% by weight and preferably from 2 to 7% by weight, based on the weight of the acid anhydride. Water is also present in the dispersion and may constitute the remainder of the dispersion up to 100% by weight.

The dispersion according to the invention can be produced by forming a mixture containing the acid anhydride, anionic polyelectrolyte and nitrogen-containing organic compound as defined above and dispersing the mixture in the presence of water. The components of the dispersion may be admixed in any order but preferably the anionic polyelectrolyte and the nitrogen-containing organic compound are mixed and diluted with water to appropriate concentration, and then the acid anhydride is dispersed therein. The mixture may be dispersed by using suitable dispersing equipment providing sufficient degree of dispersing, e.g. a static mixer providing relatively low shear forces. The obtained dispersion contains droplets of acid anhydride usually having a droplet size of from 0.1 to 10 μm in diameter.

The aqueous sizing dispersions according to the invention can be used in conventional manner in the production of paper using any type of cellulosic fibres and they can be used both for surface sizing and internal sizing. The term "paper", as used herein, is meant to include not only paper but all types of cellulosic products in sheet and web form including, for example, board and paper-board. The cellulosic suspension and finished paper can also contain mineral fillers, and usually the content of cellulosic fibres is at least 50% by weight, based on dry cellulosic suspension or finished paper. Examples of mineral fillers of conventional types include kaolin, china clay, titanium dioxide, gypsum, talc and natural and synthetic calcium carbonates such as chalk, ground marble and precipitated calcium carbonate. The present invention also relates to a process for the production of paper in which the present aqueous sizing dispersion is either added to an aqueous cellulosic suspension or applied to a cellulosic sheet or web. Suitably the amount of cellulose-reactive sizing agent either added to the cellulosic suspension to be drained on a wire to form paper, or applied to the surface of a cellulosic sheet or web as a surface size, usually at the size press, is from 0.01 to 1.0% by weight, based on dry cellulosic suspension and optional fillers, preferably from 0.05 to 0.5% by weight, where the dosage is mainly dependent on the quality of the pulp or paper to be sized and the level of sizing desired.

The aqueous sizing dispersions according to the invention are particularly useful in the manufacture of paper from an aqueous cellulosic suspension that has a high conductivity. The conductivity of the suspension that is dewatered on the wire can be within the range of from 0.3 mS/cm to 10 mS/cm. According to this invention, good results can be achieved when the conductivity is at least 2.0 mS/cm, notably at least 3.5 mS/cm, particularly at least 5.0 mS/cm and even at least 7.5 ms/cm. Conductivity can be measured by standard equipment such as, for example, a WTW LF 330 instrument supplied by Christian Berner. The values referred to above are suitably determined by measuring the conductivity of the cellulosic suspension that is fed into or present in the headbox of the paper machine or, alternatively, by measuring the conductivity of white water obtained by dewatering the suspension. High conductivity levels mean high contents of salts (electrolytes) which can be derived from the materials used to form the stock, from various additives introduced into the stock, from the fresh water supplied to the process, etc. Further, the content of salts is usually higher in processes where white water is extensively recirculated, which may lead to considerable accumulation of salts in the water circulating in the process.

Chemicals conventionally added to the cellulosic suspension in papermaking such as retention aids, aluminium compounds, dyes, wet-strength resins, optical brightening agents, etc., can of course be used in conjunction with the present dispersion. Examples of aluminium compounds include alum, aluminates and polyaluminium compounds, e.g. polyaluminium chlorides and sulphates. Examples of suitable retention aids include cationic polymers, anionic inorganic materials in combination with organic polymers, e.g. bentonite in combination with cationic polymers, silica-based sols in combination with cationic polymers or cationic and anionic polymers. Particularly good sizing can be obtained when using the dispersion of the invention in combination with retention aids comprising cationic polymers. Suitable cationic polymers include cationic starch, acrylate-based and acrylamide-based polymers, polyethyleneimine, polyamines, polyamidoamines and poly(diallyldimethyl ammoniumchloride) and combinations thereof. Preferred retention aids include cationic starch and cationic acrylamide-based polymers. In a preferred embodiment of the invention, the dispersions are used in combination with a retention system comprising at least one cationic polymer and anionic siliceous material, e.g. silica-based particles or bentonite. It is possible to pre-mix one or more components of the present dispersion with a retention aid, e.g. an anionic siliceous material, prior to introducing the mixture so obtained into the cellulosic suspension. Accordingly, the present aqueous sizing dispersion can be prepared just prior to introducing it into the cellulosic suspension by bringing into contact the acid anhydride and nitrogen containing organic compound with an anionic polyelectrolyte such as, for example, an aqueous siliceous material, e.g. a silica-based sol or bentonite slurry.

The invention is further illustrated in the following examples, which, however, are not intended to limit the same. Parts and % relate to parts by weight and % by weight, respectively, unless otherwise stated.

EXAMPLE 1

Aqueous dispersions according to the invention were prepared by dispersing alkenyl succinic anhydride (ASA) based on an olefin fraction comprising iso-hexadecenyl and iso-octadecenyl succinic anhydride in the presence of a mixture of anionic polyelectrolyte and amine in a Hash pipe static mixer.

Aqueous dispersions used for comparison in this and further examples were prepared in a similar manner, except that no amine, no colloidal silica, high molecular weight amines and/or amines having no hydroxyl groups were used.

The anionic polyelectrolyte used in this example was colloidal silica (Eka NP 590) in the form of an aqueous sol having a $SiO_2$ content of 8.1% by weight and containing silica particles with a specific surface area of 850 $m^2/g$ which were aluminum-modified. The amine used in this example was triethanol amine (TEA) having a molecular weight of 149.

The anionic polyelectrolyte and amine were mixed in the presence of water to form a mixture which was pumped into one end of the pipe at a flow of 3.17 l/min, and concentrated ASA was pumped in from the side of the pipe at a flow of 0.167 l/min. The pressure drop over the mixing unit was 3.4 bar. The obtained dispersion had an ASA content of 5% by weight, anionic polyelectrolyte content (in this example; $SiO_2$ content) of 5.0% by weight, based on the ASA, and amine content varying from 0 to 2.0% by weight, based on the ASA.

Dispersions 1 to 4 were prepared, as shown in Table 1, in which the given $SiO_2$ and amine contents are based on ASA.

TABLE 1

| Dispersion No. | $SiO_2$ (%) | TEA (%) |
|---|---|---|
| 1 | 5 | 0 |
| 2 | 5 | 0.5 |
| 3 | 5 | 1.0 |
| 4 | 5 | 2.0 |

The particle size of the ASA droplets was measured in a Malvern Mastersizer Microplus after dilution of the dispersions with water to an ASA content of 0.5% by weight. The results are shown in Table 2. D(v 0.1), D(v 0.5) and D(v 0.9) means that 10, 50 and 90% of the particles, respectively, had a diameter less than the given size.

TABLE 2

| | Particle Size (μm) | | |
|---|---|---|---|
| Dispersion | D(v 0.1) | D(v 0.5) | D(v 0.9) |
| 1 | 0.43 | 4.64 | 12.42 |
| 2 | 0.82 | 2.32 | 6.88 |
| 3 | 0.50 | 1.78 | 5.40 |
| 4 | 0.59 | 1.43 | 5.30 |

As can be seen from Table 2, the dispersions according to the present invention, Dispersion Nos. 2 to 4, resulted in smaller particle sizes over the dispersion used for comparison, Dispersion No. 1.

Sizing efficiency was evaluated by preparing hand sheets according to the standard method SCAN-C26:76 and sizing was measured as Cobb-60 values according to the standard method Tappi T441.

Paper sheets were prepared according to a process in which the dispersions were added to an aqueous cellulosic suspension comprising recycled pulp having a fiber concentration of 0.5 g/l, conductivity of 0.7 mS/cm and pH around 7.0. The dispersions were added in amounts of 0.5, 1.0 and 1.5 kg/t, calculated as ASA and based on the weight of dry cellulosic suspension. A retention system was used comprising 6 kg/t of cationic potato starch (Perlbond 970) and 0.5 kg/t of silica sol (Eka NP 442), calculated as dry substances on dry cellulosic suspension.

Cobb-60 values were measured and the results are presented in Table 3. A lower Cobb value means that a lower amount of water was absorbed and therefore better sizing was achieved.

TABLE 3

| | Cobb-60 | | |
|---|---|---|---|
| Dispersion No. | 0.5 kg/t | 1.0 kg/t | 1.5 kg/t |
| 1 | 164 | 144 | 95 |
| 2 | 142 | 42 | 29 |
| 3 | 145 | 38 | 26 |
| 4 | 48 | 24 | 21 |

As can be seen from Table 3, the dispersions according to the present invention, Dispersion Nos. 2 to 4, resulted in improved sizing efficiency over the dispersion used for comparison, Dispersion No. 1.

EXAMPLE 2

Dispersions were prepared and sizing efficiency of the dispersions was evaluated according to the general procedures of Example 1, except that varying contents of silica were used and the amine content was constant. The dispersions had an ASA content of 5% by weight, based on the weight of the dispersion. Table 4 shows the results.

TABLE 4

| Dispersion No. | $SiO_2$ (%) | TEA (%) | Cobb-60 (1 kg/t) |
|---|---|---|---|
| 5 | 0 | 2 | 29 |
| 6 | 1 | 2 | 25 |
| 7 | 3 | 2 | 23 |
| 8 | 4 | 2 | 21 |
| 9 | 5 | 2 | 25 |

As can be seen from Table 4, the dispersions according to the present invention, Dispersion Nos. 6 to 9, resulted in improved sizing efficiency over the dispersion used for comparison, Dispersion No. 5.

EXAMPLE 3

Dispersions were prepared and evaluated according to the general procedures of Example 1. Comparisons of the dispersions were made in aqueous cellulosic suspensions having increased conductivity by addition of calcium chloride. Conductivity of the suspensions was measured by using a WTW LF 330 instrument from Christian Berner. The results are presented in table 5.

TABLE 5

| Dispersion No. | ASA (%) | $SiO_2$ (%) | TEA (%) | Conductivity mS/cm | Cobb-60 0.5 kg/t | Cobb-60 1.0 kg/t | Cobb-60 1.5 kg/t |
|---|---|---|---|---|---|---|---|
| 10 | 5 | 0 | 2 | 4 | 128 | 123 | 117 |
| 11 | 5 | 5 | 2 | 4 | 126 | 108 | 48 |
| 10 | 5 | 0 | 2 | 8 | 146 | 141 | 135 |
| 11 | 5 | 5 | 2 | 8 | 125 | 105 | 47 |

As can be seen from Table 5, the dispersion according to the present invention, Dispersion No. 11, showed considerably better sizing efficiency than the dispersion used for comparison, Dispersion No. 10, when the conductivity of the suspension was increased.

EXAMPLE 4

Dispersions were prepared and evaluated according to the general procedures of Example 1, except that different amines were used. The obtained dispersion had an ASA content of 5% by weight, $SiO_2$ content of 5.0% by weight, based on the ASA, and amine content of 2.0% by weight, based on the ASA.

The amines used were triethanol amine (TEA) having a molecular weight of 149, diethylene triamine (DETA) having a molecular weight of 103, a fractioned coconut fatty amine (FCA) having a molecular weight of about 200, and a dihydrogenated tallow dimethylammonium chloride (DTDMAC) having a molecular weight of about 530.

The particle sizes are presented in Table 6.

TABLE 6

| Dispersion No. | Amine in Dispersion | Particle Size (μm) D(v 0.1) | Particle Size (μm) D(v 0.5) | Particle Size (μm) D(v 0.9) |
|---|---|---|---|---|
| 12 | DTDMAC | 0.34 | 2.05 | 9.79 |
| 13 | FCA | 0.41 | 33.2 | 211.0 |
| 14 | DETA | 0.13 | 0.41 | 1.86 |
| 15 | TEA | 0.11 | 0.27 | 0.67 |

The results of evaluation sizing efficiency are shown in Table 7.

TABLE 7

| Dispersion No. | Amine in Dispersion | Cobb-60 0.5 kg/t | Cobb-60 1.0 kg/t | Cobb-60 1.5 kg/t |
|---|---|---|---|---|
| 12 | DTDMAC | 106 | 44 | 29 |
| 13 | FCA | 114 | 83 | 39 |
| 14 | DETA | 87 | 26 | 23 |
| 15 | TEA | 51 | 26 | 21 |

As can be seen from Tables 6 and 7, the dispersions according to the present invention, Dispersion Nos. 14 and 15, which contained amines having a molecular weight less than 180 (Dispersion Nos. 14 and 15) and having hydroxyl groups (Dispersion No. 15), resulted in smaller particle size and considerably improved sizing efficiency over the dispersions used for comparison, Dispersion Nos. 12 and 13. This also means that less energy was required to set surfaces free according to the present invention.

EXAMPLE 5

Dispersions were prepared and evaluated according to the general procedures of Example 1, except that different anionic polyelectrolytes were used. The obtained dispersion had an ASA content of 5% by weight, $SiO_2$ content of 5.0% by weight, based on the ASA, and triethanol amine content 0 or 20% by weight, based on the ASA. The anionic polyelectrolytes used are shown in Table 8.

TABLE 8

| Anionic Polyelectrolyte | Description | Trade name | Primary particle size (nm) |
|---|---|---|---|
| A | Colloidal Aluminated Silica | Eka NP 590 | 3 |
| B | Colloidal Silica | Eka BMA-0 | 5.5 |
| C | Colloidal Silica | Bindzil 50/80 | 34 |
| D | Bentonite | Hydrocol | flake structure |
| E | Bentonite | Opazil AV | flake structure |

The bentonites were slurried in water (5% by weight bentonite) and stored for 5 days in order to achieve sufficient swelling and delamination.

Particle size was determined and stability was evaluated. Stability was measured 2 hours after preparation. If still stable after 24 hours, the particle size was determined again. The term "sep." means separation. The results are shown in Table 9.

TABLE 9

| Dispersion No. | Anionic Poly-electrolyte | Amine Content (%) | Particle Size (μm) D(v 0.1) | Particle Size (μm) D(v 0.5) | Particle Size (μm) D(v 0.9) | Stability/ Separation (2 h) | D(v 0.5) (24 h) |
|---|---|---|---|---|---|---|---|
| 16 | A | — | 0.21 | 1.21 | 8.29 | Small sep. | — |
| 17 | A | 2 | 0.10 | 0.27 | 0.83 | Stable | 0.27 |

TABLE 9-continued

| Dispersion No. | Anionic Poly-electrolyte | Amine Content (%) | Particle Size (μm) D(v 0.1) | D(v 0.5) | D(v 0.9) | Stability/ Separation (2 h) | D(v 0.5) (24 h) |
|---|---|---|---|---|---|---|---|
| 18 | B | — | 0.25 | 1.26 | 6.69 | Small sep. | — |
| 19 | B | 2 | 0.16 | 0.33 | 0.80 | Stable | 0.27 |
| 20 | C | — | 0.27 | 1.99 | 13.24 | Small sep. | — |
| 21 | C | 2 | 0.10 | 0.27 | 0.70 | Stable | 0.27 |
| 22 | D | — | 0.20 | 1.74 | 10.67 | Separation | — |
| 23 | D | 2 | 0.10 | 0.25 | 0.66 | Stable | 0.23 |
| 24 | E | — | 14.32 | 24.5 | 38.8 | Separation | — |
| 25 | E | 2 | 0.11 | 0.27 | 0.64 | Stable | 0.25 |

The results of evaluating sizing efficiency are shown in Table 10.

TABLE 10

| Dispersion No. | Anionic Poly-electrolyte | Amine Content (%) | Cobb-60 0.5 kg/t | 0.75 kg/t | 1.0 kg/t |
|---|---|---|---|---|---|
| 16 | A | — | 128 | 103 | 64 |
| 17 | A | 2 | 89 | 44 | 29 |
| 18 | B | — | 129 | 62 | 33 |
| 19 | B | 2 | 91 | 40 | 33 |
| 20 | C | — | 116 | 102 | 66 |
| 21 | C | 2 | 128 | 45 | 31 |
| 22 | D | — | 120 | 112 | 91 |
| 23 | D | 2 | 88 | 34 | 28 |
| 24 | E | — | 122 | 127 | 120 |
| 25 | E | 2 | 99 | 41 | 29 |

As can be seen from Tables 9 and 10, the dispersions according to the present invention, Dispersion Nos. 17, 19, 21, 23, and 25, which contained both anionic polyelectrolyte and nitrogen-containing organic compound, showed better sizing efficiency, better stability and resulted in smaller particle size over the dispersions used for comparison, Dispersion Nos. 16, 18, 20, 22 and 24, which contained no nitrogen-containing organic compound.

EXAMPLE 6

Dispersions were prepared and particle size and sizing efficiency of the dispersions were evaluated according to the general procedures of Example 1, except that different surfactants and varying contents of the surfactants were used. The anionic polyelectrolyte used was colloidal silica (Eka NP 780) in the form of aqueous sol having a $SiO_2$ content of 7.5% by weight and containing silica particles with a specific surface area of about 900 $m^2/g$ and which were aluminium modified. The amine used was triethanol amine (TEA). The obtained dispersion had an ASA content of 5% by weight, $SiO_2$ content of 5.0% by weight, based on the ASA, and amine content of 2.0% by weight, based on the ASA.

No surfactant was incorporated into the Dispersion No. 26. Hydrolyzed ASA was incorporated as surfactant into Dispersion Nos. 27 and 28. The surfactant used in Dispersion No. 29 was a phosphate ester (poly(oxy-1,2-ethanediyl) alpha-isotridecyl-omega-hydroxyphosphate). The surfactant contents in the dispersions were based on ASA. The results of the particle size measurements are shown in Table 11.

TABLE 11

| Dispersion No. | Surfactant in Dispersion | Surfactant Content (%) | Particle Size (μm) D (v 0.1) | D (v 0.5) | D (v 0.9) |
|---|---|---|---|---|---|
| 26 | — | — | 0.33 | 4.67 | 14.53 |
| 27 | hydrolyzed ASA | 1 | 0.29 | 2.42 | 7.63 |
| 28 | hydrolyzed ASA | 2.5 | 0.12 | 0.45 | 1.83 |
| 29 | phosphate ester | 1 | 0.17 | 1.05 | 4.16 |

Sizing efficiency of the dispersions was evaluated and comparisons of the dispersions were made in an aqueous cellulosic suspension comprising 70% pulp (80/20 birch/pine kraft) and 30% filler ($CaCO_3$).

TABLE 12

| Dispersion No. | Conductivity mS/cm | Cobb-60 0.5 kg/t | 0.75 kg/t | 1.0 kg/t |
|---|---|---|---|---|
| 26 | 0.4 | 91 | 84 | 70 |
| 27 | 0.4 | 81 | 69 | 54 |
| 28 | 0.4 | 72 | 48 | 31 |
| 29 | 0.4 | 76 | 49 | 41 |
| 26 | 0.7 | 87 | 78 | 75 |
| 27 | 0.7 | 81 | 64 | 54 |
| 28 | 0.7 | 76 | 47 | 31 |
| 29 | 0.7 | 73 | 52 | 37 |

As can be seen from the results presented in Tables 11 and 12, Dispersion Nos. 27, 28 and 29 containing a surfactant resulted in smaller particle size and showed better sizing efficiency than the dispersion containing no surfactant.

EXAMPLE 7

The dispersions of Example 6 were evaluated in terms of sizing efficiency when using aqueous cellulosic suspensions comprising unbleached kraft pulp having varying conductivities. The results are shown in Table 13.

TABLE 13

| Dispersion No. | Conductivity mS/cm | Cobb-60 0.5 kg/t | 0.75 kg/t | 1.0 kg/t |
|---|---|---|---|---|
| 26 | 0.4 | 100 | 72 | 37 |
| 27 | 0.4 | 86 | 42 | 27 |
| 28 | 0.4 | 40 | 28 | 23 |
| 29 | 0.4 | 49 | 28 | 22 |
| 28 | 0.7 | 44 | 27 | 22 |
| 26 | 4.0 | 97 | 100 | 76 |

TABLE 13-continued

| Dispersion No. | Conductivity mS/cm | Cobb-60 | | |
|---|---|---|---|---|
| | | 0.5 kg/t | 0.75 kg/t | 1.0 kg/t |
| 27 | 4.0 | 89 | 52 | 28 |
| 28 | 4.0 | 44 | 27 | 23 |
| 29 | 4.0 | 102 | 98 | 76 |

As can be seen from Table 13, Dispersion Nos. 27, 28 and 29 containing a surfactant showed better sizing efficiency than the dispersion containing no surfactant, Dispersion No. 26.

The invention claimed is:

1. Aqueous dispersion of cellulose-reactive sizing agent containing an acid anhydride, an anionic polyelectrolyte and a nitrogen-containing organic compound which is an amine or quaternary ammonium thereof having a molecular weight less than 180.

2. The aqueous dispersion according to claim 1, wherein the nitrogen-containing compound has one or more hydroxyl groups.

3. The aqueous dispersion according to claim 2, wherein one or more hydroxyl groups are present in a terminal position of one or more substituents of the nitrogen-containing compound.

4. The aqueous dispersion according to claim 1, wherein the nitrogen-containing compound is diethylene triamine, triethylene tetramine, hexamethylene diamine, diethyl amine, dipropyl amine, di-isopropyl amine, cyclohexylamine, pyrrolidine, guanidine, triethanol amine, monoethanol amine, diethanol amine, 2-methoxyethyl amine, aminoethylethanol amine, alanine, lysine, choline hydroxide, tetramethyl ammoniumhydroxide or tetraethyl ammoniumhydroxide.

5. The aqueous dispersion according to claim 1, wherein the anionic polyelectrolyte is a siliceous material.

6. The aqueous dispersion according to claim 1, wherein the acid anhydride is iso-octadecenyl succinic anhydride, iso-octadecyl succinic anhydride, n-hexadecenyl succinic anhydride, dodecenyl succinic anhydride, decenyl succinic anhydride, octenyl succinic anhydride, tri-isobutenyl succinic anhydride, 1-octyl-2-decenyl-succinic anhydride or 1-hexyl-2-octenyl-succinic anhydride.

7. The aqueous dispersion according to claim 1, wherein the acid anhydride is present in an amount of from 0.1 to 30% by weight, based on the weight of the aqueous dispersion.

8. The aqueous dispersion according to claim 1, wherein the anionic polyelectrolyte is present in an amount of from 0.5 to 10% by weight, based on the weight of the acid anhydride.

9. The aqueous dispersion according to claim 1, wherein the nitrogen containing organic compound is present in an amount of from 0.5 to 10% by weight, based on the weight of the acid anhydride.

10. The aqueous dispersion according to claim 1, wherein the dispersion further comprises an anionic surfactant.

11. The aqueous dispersion according to claim 10, wherein the anionic surfactant is hydrolyzed acid anhydride.

12. A process for the production of paper which comprises adding an aqueous dispersion of cellulose-reactive sizing agent to an aqueous cellulosic suspension and dewatering the obtained suspension on a wire, or by applying an aqueous dispersion of cellulose-reactive sizing agent to the surface of a cellulosic sheet or web, wherein the dispersion is the aqueous dispersion of cellulose-reactive sizing agent according to claim 1.

* * * * *